US006152573A

United States Patent [19]

Mitchell

[11] Patent Number: 6,152,573

[45] Date of Patent: Nov. 28, 2000

[54] LENS RETAINER FOR LIGHTED SIGN

[76] Inventor: Cary L. Mitchell, 7917 Summit Cove, Fort Worth, Tex. 76179

[21] Appl. No.: 09/129,661

[22] Filed: Aug. 5, 1998

[51] Int. Cl.[7] ..... F21S 3/00; F21V 11/00; F21V 21/00; F21V 17/00

[52] U.S. Cl. ..... 362/217; 362/223; 362/374; 362/375; 362/361

[58] Field of Search ..... 362/223, 217, 362/311, 374, 375, 361, 355

[56] References Cited

U.S. PATENT DOCUMENTS

| | | | |
|---|---|---|---|
| 2,269,182 | 1/1942 | Claspy et al. . | |
| 2,312,393 | 3/1943 | Donnelly | 362/375 |
| 4,323,954 | 4/1982 | Florence et al. . | |
| 4,667,275 | 5/1987 | Herst et al. . | |
| 4,680,684 | 7/1987 | Wolber . | |
| 5,001,613 | 3/1991 | Foster et al. | 362/223 |
| 5,020,252 | 6/1991 | De Boef | 362/223 |
| 5,113,328 | 5/1992 | Foster et al. | 362/223 |
| 5,142,466 | 8/1992 | Foster et al. | 362/223 |
| 5,245,518 | 9/1993 | Aspenwall | 362/217 |
| 5,349,510 | 9/1994 | Jordan et al. | 362/374 |
| 5,558,431 | 9/1996 | Wilson | 362/223 |
| 5,584,547 | 12/1996 | Trulaske, Sr. | 362/223 |
| 5,746,502 | 5/1998 | Huang . | |
| 5,906,427 | 5/1999 | Noh | 362/223 |

*Primary Examiner*—Sandra O'Shea
*Assistant Examiner*—Bryan P. Stanley
*Attorney, Agent, or Firm*—James E. Bradley; Felsman, Bradley, Vaden, Gunter & Dillon, LLP

[57] ABSTRACT

A light assembly has a translucent lens which is flexibly mounted to a mounting bracket containing a light source. The lens has a series of spaced-apart members located near its upper and lower edges. The members are mounted in holes in the lens and extend through both sides of the lens to form rigid protrusions. The mounting bracket is an extruded metal member with a retention joint on each end. Each retention joint has a pair of fingers which define a narrow recess with an internal lip. The width of the lens is greater than the distance between the retention joints so that the lens may be flexed into a bowed configuration. The light assembly is designed to be mounted as a sign which extends circumferencially around a structure or building. The mounting bracket is secured to the building. The lens is installed by first inserting its lower edge into the recess on the lower retention joint of the mounting bracket. The lens is properly seated when the lower set of members on the lens snap into the lower recess inside its lip. The lens is flexed to its bowed, convex configuration, until the upper end of the lens is similarly mounted in the recess at the upper end of the mounting bracket. The upper end of the lens is properly seated when its set of members snap into the upper recess inside its lip. The light from the light source illuminates the lens to create a colored uniform glow to the light assembly.

17 Claims, 1 Drawing Sheet

LENS RETAINER FOR LIGHTED SIGN

TECHNICAL FIELD

This invention relates in general to lighted signs and in particular to a lighted sign having a lens and a lens retainer.

BACKGROUND ART

Lighted signs having a mounting bracket, a light source and a flexible, translucent plastic lens which is illuminated from the light source are fairly common in the art. One type of prior art lighted sign comprises a lighted strip that extends along the edge of a roof to outline a building. Generally, these strips have a metal base fastened to the roof and the light source is mounted to the base. A plastic lens mounts to the base over the light source. While this design is workable, improvements are desired.

DISCLOSURE OF THE INVENTION

A light assembly has a translucent lens which is flexibly mounted to a mounting bracket containing a light source. The lens has a series of spaced-apart members located near its upper and lower edges. The members are mounted in holes in the lens and extend through both sides of the lens to form rigid protrusions. The mounting bracket is an extruded metal member with a retention joint on each end. Each retention joint has a pair of fingers which define a narrow recess with an internal lip. The width of the lens is greater than the distance between the retention joints so that the lens may be flexed into a bowed configuration.

The light assembly is designed to be mounted as a sign which extends circumferentially around a structure or building. The mounting bracket is secured to the building. The lens is installed by first inserting its lower edge into the recess on the lower retention joint of the mounting bracket. The lens is properly seated when the lower set of members on the lens snap into the lower recess inside its lip. The lens is flexed to its bowed, convex configuration, until the upper end of the lens is similarly mounted in the recess at the upper end of the mounting bracket. The upper end of the lens is properly seated when its set of members snap into the upper recess inside its lip. The light from the light source illuminates the lens to create a colored uniform glow to the light assembly.

BEST MODE FOR CARRYING OUT THE INVENTION

Figure 1:
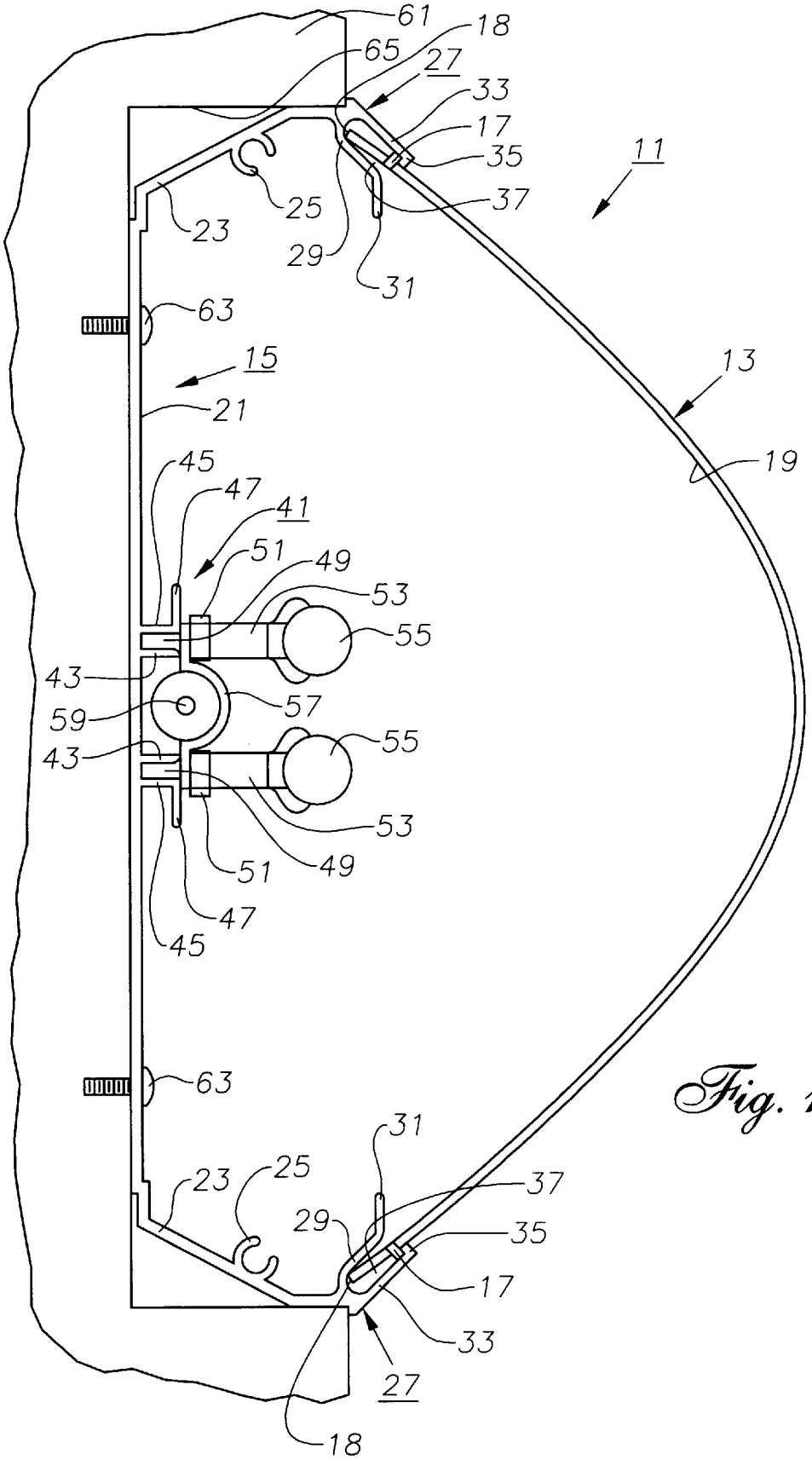
FIG. 1 is a sectional side view of a lens retainer and lens constructed in accordance with the invention.

Referring to FIG. 1, a light assembly 11 having a translucent lens 13 flexibly mounted to a mounting bracket 15 is shown. Prior to installation, lens 13 is a thin, flat, rectangular plastic sheet with a series of spaced-apart members 17 located near its upper and lower edges 18. In the embodiment shown, lens 13 comprises a cold-formed, 0.060 inch thick sheet of clear plastic which is coated on an interior surface 19 with a very thin layer of colored translucent vinyl. Members 17 are metal members which may be the same as the male portion of conventional snap fasteners. Members 17 are spaced a few inches apart. Members 17 are mounted in holes in lens 13 and extend through both sides of lens 13 to form rigid protrusions. Lens 13 has approximately the same length as mounting bracket 15, but may be cut to shape corners on each end to register with another lens 13 (not shown).

Mounting bracket 15 is an extruded metal member and is preferably formed from aluminum. Mounting bracket 15 has a large flat base portion 21 and symmetrical upper and lower flange portions 23 which extend outward and away from base portion 21. Flange portions 23 are at an obtuse angle of approximately 120 degrees relative to base portion 21. Each flange portion 23 has a small C-shaped retainer 25 integrally formed on an inner surface. In an alternate embodiment (not shown), retainer 25 may be employed for fastening a light fixture.

A retention joint 27 is located at the end of each flange portion 23. Each retention joint 27 comprises an inner finger 29 with a vertical portion 31, and an outer finger 33 with a lip 35. A narrow recess 37 is located between the outer surface of inner finger 29 and the inner surface of outer finger 33. Inner finger 29 and outer finger 33 extend generally inward relative to base portion 21 such that an obtuse angle of approximately 120 degrees is formed between flange portions 23 and their respective retention joints 27. Vertical portions 31 extend inward toward one another and are generally parallel to base portion 21. Each lip 35 is essentially perpendicular to its respective outer finger 33.

The width of lens 13 from one edge 18 to another edge 18 is greater than the distance between retention joints 27. Lens 13 is flexible and resilient so that it may be flexed into the bowed configuration shown.

Mounting bracket 15 also comprises a pair of symmetrical light brackets 41 integrally formed on its inner surface near the midsection of base portion 21. Each light bracket 41 has an inner wall 43, a parallel outer wall 45 with a perpendicular flange 47, and a slot 49 therebetween. Slot 49 receives a fastener 51 which extends through a tube support 53. A 15 mm neon tube 55 is mounted and connected to each tube support 53. An elongated track 57 is located between light brackets 41 and is also secured with fasteners 51. Track 57 is provided for safely retaining electrical wiring 59 and transformers for neon tubes 55. Alternatively, a fluorescent tube (not shown) may be employed.

In operation, light assembly 11 is provided as a sign which extends circumferentially around a structure or building, particularly an edge of a roof. Mounting bracket 15 is secured to a structure 61 with fasteners 63. Preferably, mounting bracket 15 will be located in a recess 65 in structure 61 such that only retention joints 27 are exposed. Neon tubes 55 are then installed and electrical wiring 59 is connected to a power supply.

Lens 13 is installed by first inserting its lower edge 18 into recess 37 on the lower end of mounting bracket 15. Vertical portion 31 helps the lower edge of lens 13 slide downward into recess 37. Lens 13 is properly seated when the lower set of members 17 snap into recess 37 inside lip 35. Lens 13 is then flexed from its flat configuration (not shown) to a bowed, convex configuration, until the upper end 18 of lens 13 is similarly mounted in recess 37 at the upper end of mounting bracket 15. The vertical portion 31 at the upper end helps the upper edge of lens 13 slide upward into recess 37. The upper end of lens 13 is properly seated when its set of members 17 snap into recess 37 inside lip 35. The resiliency of lens 13 further assists in retaining lens 13 to mounting bracket 15. When neon tubes 55 are turned on, their light illuminates the vinyl on the inner surface 19 of lens 13 to create a colored uniform glow to light assembly 11. When the ends of light assembly 11 are joined with the ends of other light assemblies 11 (not shown), a seamless lighted sign is formed which appears to extend around corners of the mounting structure.

The invention has several advantages. The extruded mounting bracket has separate tracks for electrical leads and tube supports. The member features on the lens allow the width of the lens to be sized to match the mounting bracket. The lens may be cut to a desired width and the members attached at the edge. This avoids having to form a lens to a desired bowed configuration. In addition, the configuration of the mounting bracket and lens enables the corners and ends of the sign to be illuminated.

While the invention has been shown or described in only some of its forms, it should be apparent to those skilled in the art that it is not so limited, but is susceptible to various changes without departing from the scope of the invention.

I claim:

1. A light assembly, comprising:

a mounting bracket having a base with first and second edges, and a flange extending along a length of the mounting bracket from each of the edges of the base;

a light source mounted to the mounting bracket;

a lip on each of the flanges of the mounting bracket;

a normally flat, resilient lens having first and second edges, the lens being flexed into a generally U-shaped configuration; and at least one protrusion located near each of the first and second edges of the lens, each of the protrusions being held in engagement with one of the lips solely due to the resiliency of the lens for retaining the lens in the mounting bracket in a convex configuration.

2. The light assembly of claim 1, wherein each of the flanges comprise inner and outer fingers which define a recess therebetween that receives one of the edges of the lens.

3. The light assembly of claim 2 wherein the lip on each of the flanges of the mounting bracket is located in one of the recesses on one of the fingers.

4. The light assembly of claim 2 wherein one of the fingers of each of the flanges has a guide member portion that diverges from the other finger of each of the flanges for facilitating entry of one of the edges of the lens into the recess.

5. The light assembly of claim 2 wherein the lip is located on an inward facing surface of each of the outer fingers.

6. The light assembly of claim 1 wherein said at least one protrusion comprises a plurality of protrusions spaced apart from each other along a length of the lens.

7. The light assembly of claim 6 wherein the protrusions are metal members which are mounted in holes in the lens.

8. A light assembly, comprising:

a mounting bracket having a base with first and second edges, and a flange extending along a length of the mounting bracket from each of the first and second edges of the base;

a light source mounted to the mounting bracket;

a retention joint on each flange containing a recess having an entrance and a bottom;

a lip on each of the retention joints extending into the recess;

a resilient lens having first and second edges extending into the recesses of the retention joints, respectively, while in a mounted position, the lens being flat in an unmounted position and bowed into a convex configuration while in the mounted position; and a plurality of rigid protrusions located near each of the first and second edges of the lens, spaced apart along a length of the lens, and located in the recesses, the resiliency of the lens urging the protrusions against the lips for retaining the lens in the mounting bracket in the convex configuration.

9. The light assembly of claim 8 wherein each retention joint has inner and outer fingers which define the recess therebetween, and wherein the lip in each recess is located on an inward facing surface of the outer finger.

10. The light assembly of claim 9 wherein each of the inner fingers has a guide member portion that diverges from the outer finger for facilitating entry of one of the edges of the lens into the recess.

11. The light assembly of claim 9 wherein each of the protrusions is spaced a selected distance from one of the edges of the lens, and wherein each of the edges of the lens contacts an outward facing surface of one of the inner fingers adjacent the bottom of the recess.

12. The light assembly of claim 8 wherein the protrusions are metal members which are mounted in holes in the lens.

13. The light assembly of claim 8 wherein the light source comprises a tube.

14. A light assembly, comprising:

a mounting bracket having a base with first and second edges, and a flange extending along a length of the mounting bracket from each of the first and second edges of the base;

a light source mounted to the mounting bracket;

a retention joint on each flange having inner and outer fingers which define a recess therebetween;

an inward extending lip on each of the outer fingers of each of the retention joints;

a resilient, plastic lens having first and second edges extending into the recesses of the retention joints, respectively, the lens being flat in an unmounted condition and flexed into a convex configuration while in a mounted position;

a plurality of rigid protrusions located near each of the first and second edges of the lens and spaced apart along a length of the lens, the resiliency of the lens urging the protrusions into contact with the lips in the recesses, for retaining the lens in the mounting bracket in the mounted position; and a guide member located on the inner finger and diverging from the outer finger for facilitating entry of one of the edges of the lens into the recess.

15. The light assembly of claim 14 wherein each of the protrusions is spaced a selected distance from one of the edges of the lens, and wherein each of the edges of the lens is in contact with an outward facing surface of one of the inner fingers.

16. The light assembly of claim 14 wherein the rigid protrusions are metal members which are mounted in holes in the lens.

17. The light assembly of claim 14 wherein the light source comprises a tube.

* * * * *